United States Patent [19]

Netzer

[11] 4,211,540

[45] Jul. 8, 1980

[54] PROCESS FOR THE MANUFACTURE OF FUEL GAS

[75] Inventor: David Netzer, Stafford, Tex.

[73] Assignee: Fluor Corporation, Irvine, Calif.

[21] Appl. No.: 974,221

[22] Filed: Dec. 29, 1978

[51] Int. Cl.[2] ..... C10J 3/08; C10J 3/16; C10J 3/46

[52] U.S. Cl. ..... 48/202; 48/203; 48/206; 48/DIG. 7; 252/373; 260/449 M; 260/449.5; 423/359; 423/648 R

[58] Field of Search ..... 48/202, 203, 206, 210, 48/DIG. 7; 252/373; 260/449 M, 449.5; 60/39.02; 423/359, 648 R

[56] References Cited

U.S. PATENT DOCUMENTS

| | | | |
|---|---|---|---|
| 3,540,867 | 11/1970 | Baron et al. | 48/206 |
| 3,966,633 | 6/1976 | Friedman | 48/202 |
| 3,971,636 | 7/1976 | Matthews | 48/202 |
| 4,017,272 | 4/1977 | Ownes et al. | 48/202 |
| 4,085,578 | 4/1978 | Kydd | 60/39.02 |

*Primary Examiner*—S. Leon Bashore
*Assistant Examiner*—Peter F. Kratz
*Attorney, Agent, or Firm*—Lyon & Lyon

[57] ABSTRACT

An improved process is disclosed for the production of fuel gas such as synthetic natural gas from coal. A sized coal feed of larger particle size is gasified in a moving bed gasifier such as the British Gas/Lurgi slagging gasifier, and forms a methane rich synthesis gas containing heavy and light organics which is quenched to form a water phase containing dissolved phenolic and other compounds. The water phase is separated from the gas phase and insoluble organics and mixed with a second portion of the coal containing fine particles which are not suitable for moving bed gasification to form a slurry. This coal-phenolic water slurry is gasified in an entrained bed gasifier, for example, the Texaco partial oxidation process, and forms a methane lean synthesis gas. The phenol, ammonia and dissolved organics in the water phase are destroyed and converted to valuable product gas. At least part of this product gas may be blended with the moving bed product gas for further processing to produce the desired fuel gas product. The product gas from the entrained bed gasifier is also suitable for production of hydrogen, ammonia, or methanol.

8 Claims, 1 Drawing Figure

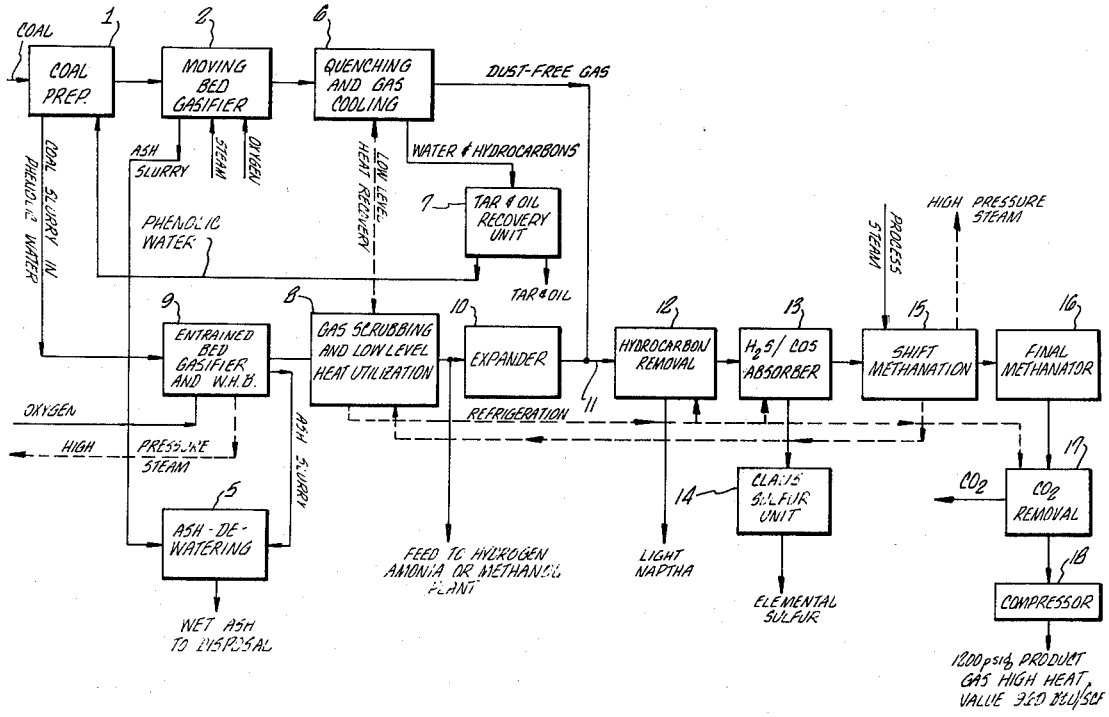

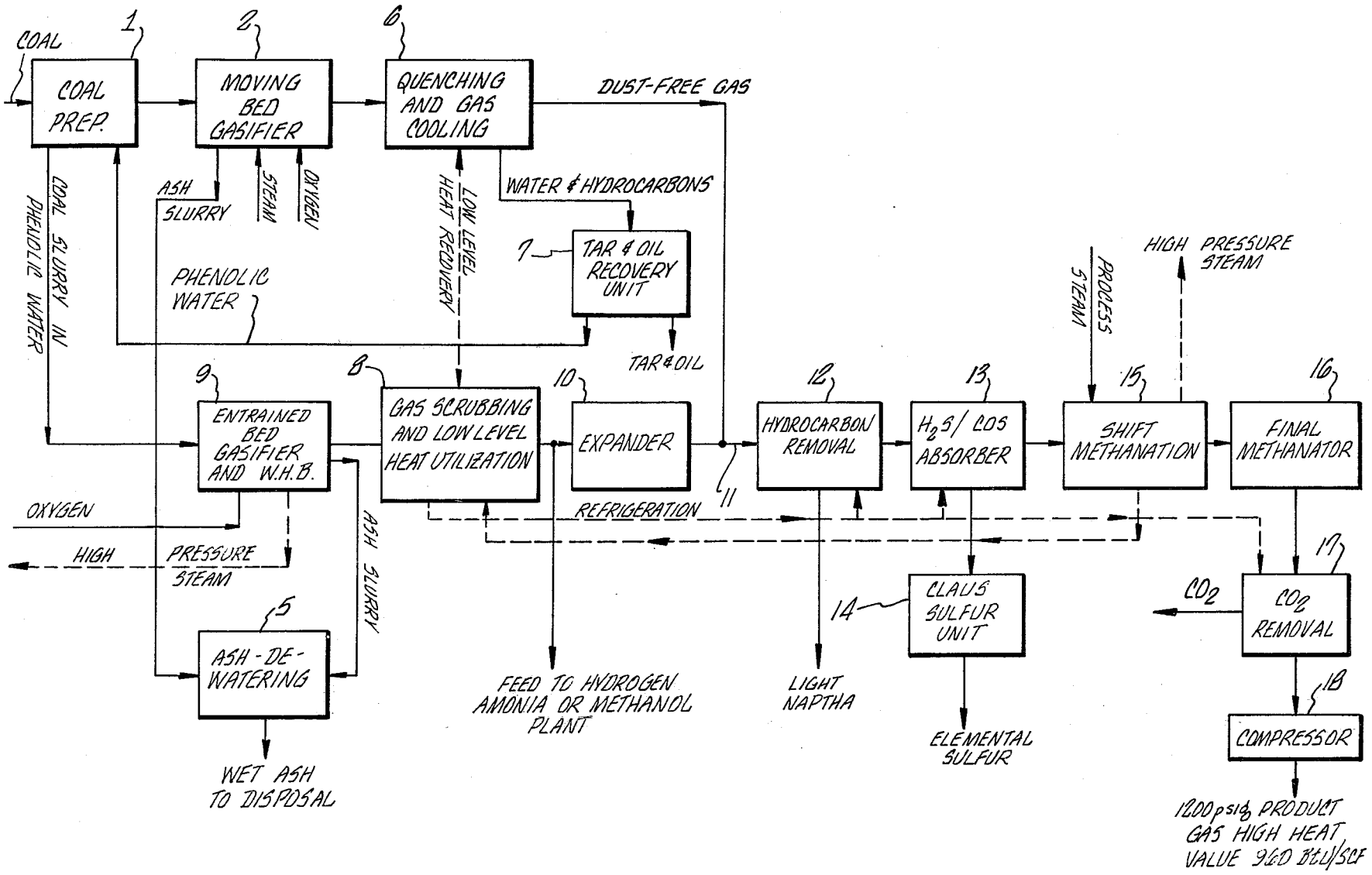
COAL
COAL PREP.
1
COAL SLURRY IN PHENOLIC WATER
MOVING BED GASIFIER
2
OXYGEN
STEAM
ASH SLURRY
PHENOLIC WATER
QUENCHING AND GAS COOLING
6
WATER & HYDROCARBONS
DUST-FREE GAS
TAR & OIL RECOVERY UNIT
7
TAR & OIL
LOW LEVEL HEAT RECOVERY
GAS SCRUBBING AND LOW LEVEL HEAT UTILIZATION
8
ENTRAINED BED GASIFIER AND W.H.B.
9
ASH SLURRY
OXYGEN
HIGH
PRESSURE STEAM
ASH-DE-WATERING
5
WET ASH TO DISPOSAL
EXPANDER
10
REFRIGERATION
FEED TO HYDROGEN AMMONIA OR METHANOL PLANT
11
HYDROCARBON REMOVAL
12
LIGHT NAPTHA
$H_2S$/COS ABSORBER
13
CLAUS SULFUR UNIT
14
ELEMENTAL SULFUR
PROCESS STEAM
SHIFT METHANATION
15
HIGH PRESSURE STEAM
FINAL METHANATOR
16
$CO_2$ REMOVAL
17
$CO_2$
COMPRESSOR
18
1000 psig PRODUCT GAS HIGH HEAT VALUE 920 BTU/SCF

PROCESS FOR THE MANUFACTURE OF FUEL GAS

BACKGROUND OF THE INVENTION

This country's increasing dependence upon foreign sources of petroleum and natural gas has caused considerable consternation. Since native resources are dwindling precipitously, increased efforts must be made, in view of our vast coal fields, to move away from petroleum by-products and natural gas to coal derivatives. However, many industries cannot be readily transformed from natural gas to coal directly without incurring prohibitive costs. In order to avoid these enormous changeover costs, attempts have been made to economically convert coal into a natural gas substitute. This coal derivative has been denominated synthetic natural gas (SNG) to distinguish it from natural gas obtained at the well head.

Various methods of coal gasification are well known in the art. The two more common procedures are the moving bed gasification process, exemplified by the conventional Lurgi dry bottom and the British Gas Co. (BGC) Lurgi slagging gasifier, and the entrained bed gasification process such as the Koppers-Totzek or the Texaco Partial Oxidation Process.

In the moving bed process, the bulk of the gasification is carried out at a relatively low temperature of about 1200°-1600° F. in the coal bed. In this temperature range, a substantial amount of methane is formed which becomes part of the product along with methane subsequently produced in later process steps. This methane produced in the gasifier is called primary methane. Final gasification at the bottom of the bed can be carried out at about 1600° F. in the coal bed if the ash is to be below fusion temperature (like conventional Lurgi) or above the flow temperature of molten ash (about 2400°-2800° F.) as British Gas Corp Lurgi Slagging Process.

By heating the coal to the gasification temperature (1200°-1600° F.), devolatilization of the coal takes place which results in co-production of tar, oil, phenol, ammonia, HCN and many organic components. These components leave the gasifier along with the crude synthesis gas and undecomposed steam. After cooling the synthesis gas, a phenolic liquid containing dissolved phenol, $NH_3$, HCN, $CO_2$, $H_2S$ is rejected from the process and needs to be treated in order to become environmentally accepted as a waste effluent. This problem is particularly severe in the conventional non-slagging moving bed process because the gasifier bottom, due to process requirements, is kept below the ash fusion temperature which calls for a very large steam injection in order to quench the gasifier bottom zone. This results in a very large quantity of unconverted steam in the gasifier overhead, and consequently very large quantities of phenolic condensate must be treated. Both slagging and non-slagging moving bed processes need sized coal (usually ¼"-2" range). In the sizing process, about 10-35% of the coal will be reduced to a size smaller than ¼" and cannot be gasified. This fine coal is usually used as a boiler fuel.

If a slagging moving bed process is employed, the steam requirement for gasification is greatly reduced as compared with non-slagging processes because no steam is needed to quench the bottom zone. As a result, the thermal efficiency of the process is higher and the amount of phenolic condensate to be treated is reduced.

The treatment of the phenolic condensate includes phenol extraction, ammonia recovery, and bio-treatment. Because the steam requirement is greatly reduced, coal fines that otherwise could be used as a boiler fuel can no longer be used.

If entrained bed gasification is used on a stand-alone basis, SNG production may not be economical. The high temperature of gasification (2200°-2700° F.) will lead to a very large oxygen requirement, very low primary methane formation, and consequently, to a very large shift methanation unit and a relatively low $H_2S/CO_2$ ratio in the gas to be desulfurized (i.e., selective $H_2S$ recovery is probably required which is more expensive). The overall thermal efficiency of coal to SNG by entrained bed gasification is lower than moving bed, and the capital cost is higher. The advantage of the entrained bed is that no tar, oil, phenol and ammonia by-products are produced, and consequently, environmental problems are greatly reduced.

SUMMARY OF THE INVENTION

It has been discovered that many of the foregoing problems may be alleviated. Thus, according to the invention, a moving bed slagging process such as BGC/Lurgi and an entrained bed, slurry fed gasification process such as Texaco Partial Oxidation are used in a combined mode. Initially, coal is fed to the crushing-sizing cycle, whereupon the sized coal, usually 65-90% of the feed, is fed to the moving bed process while phenolic condensate recovered downstream is used to slurry the rejected fines, which amount to 10-35% of the feed. The coal slurry in the phenolic condensate is used as feed to the entrained bed gasification. This concept may be used also with non-slagging processes such as the Lurgi dry bottom, but the ratio of phenolic condensate to coal fines will make the slurry very dilute (typically less than about 20 weight percent) and consequently the overall scheme may not be economical. Any other process that generates a significant amount of primary methane will produce phenolic condensate, and hence this invention may also be applicable. For example, phenolic water derived from I.G.T. HyGas TM Process can be used to slurry coal fines or unconverted char (which is a gasification by-product), and the slurry can be gasified in entrained bed gasifiers.

The slurry of the coal fines in phenolic water proceeds to a wet grinding circuit where the coal is ground to a fine mesh and fed as 45-67 wt.% slurry to an entrained bed gasifier. The coal fines are gasified, and the phenol, ammonia and organic contents of the water as destroyed and converted to a valuable synthesis gas. If the desired product is fuel gas, either medium BTU gas (300-400 BTU/SCF) or SNG, the gases from the two gasification processes are blended and proceed to $H_2S$/COS removal. If SNG is the desired product, the desulfurized gas proceeds to a combined shift-methanation process such as R. M. Parsons Process, I.C.I. Process, or Chem Systems Process. The methanated gas proceeds to $CO_2$ removal and then to product gas compression. If, in addition to fuel gas, it is desired to make another product such as methanol, ammonia or hydrogen, at least part of the gas from the entrained bed gasifier is not blended with the gas from the moving bed gasifier and is converted to one of these materials using the appropriate well-known technology.

Principal advantages of this invention compared to conventional coal gasification processes for SNG are:

(a) Significant production of primary methane with, ultimately, no production of phenol and ammonia by-products.

(b) The ability to maintain heat balance by combustion of tar and oil by-products in a steam superheater with excess steam converted to electric power (if required).

(c) Elimination of the need for phenolic liquor extration, ammonia recovery, sour water stripping, and biotreatment.

(d) Economical use of the coal fines that otherwise may exceed the steam generation need.

(e) By using an entrained bed process, part of the synthesis gas is lean in methane and can be used economically for making ammonia, methanol, or hydrogen in large quantities.

(f) Relatively high ratio of $H_2S$ to $CO_2$ in the acid gas entering the acid gas removal. This, in many cases, will eliminate need for selective $H_2S$ removal and yet the $H_2S$ concentration of the $H_2S$ rich gas will exceed 15% (i.e., suitable for a conventional Claus sulfur plant).

(g) Due to the complete destruction of dissolved organics, the environmental impact of the plant is greatly reduced.

BRIEF DESCRIPTION OF THE DRAWING

FIG. 1 illustrates schematically the improved process of the present invention for SNG production.

DETAILED DESCRIPTION OF THE INVENTION

In the process of the present invention, typical conditions are presented. Coal is fed to a coal preparation plant 1 to generate ¼" to 2" sized coal to feed the moving bed gasifiers. On the average, about 20% of the coal passes through the ¼" screen and is unacceptable as a feed to the moving bed gasifier. The sized coal is fed from the coal preparation plant 1 to the moving bed gasifiers 2 where the coal is gasified at pressures of 350–550 psig, usually at about 430 psig. A portion of the coal is devolatilized in the upper section of the gasifier 2, and the ash is slagged in the bottom section. Gas containing tar, oil, phenol and ammonia as well as traces of coal dust, leaves the gasifier 2 at a temperature in a range of about 600° F. to about 1000° F., usually at about 800° F. Molten ash at about 2300° F. to about 2800° F. flows from the bottom section of the gasifier and is quenched by recycle water, and carried to an ash dewatering unit 5 and disposed.

For Illinois No. 6 coal (12,235 BTU/lb) having the following coal analysis:

| | |
|---|---|
| C | 69.52% |
| H | 5.32% |
| O | 10.02% |
| N | 1.28% |
| S | 3.86% |
| Ash | 10.00% |
| | 100.00% |

Free Moisture 4.87%; the crude gas yield from the moving bed gasifier will be approximately:

CO: 53.40%
$H_2$: 29.00%
$CO_2$: 1.85%
$CH_4$: 6.88%
$C_2H_4$: 0.20%
$C_2H_6$: 0.30%
$N_2$: 0.23%
A: 0.08%
$H_2S$: 1.33%
COS: 0.06%
$NH_3$: 0.50%
$H_2O$: 5.60%
Tar: 0.20%
Oil: 0.13%
Naphtha: 0.08%
Crude Phenol: 0.13%
HCN: 0.04%

The average molecular weights respectively of the tar, oil, naphtha and crude phenol are estimated to be 220, 145, 85 and 105. The total sized coal feed of 13,621 tons per day yields a total gas flow of 90,770 mol/hr.

The gas from the gasifier 2 is quenched by recycled water in quenching and gas cooling unit 6 and reduced to a temperature in the range of about 300° F. to about 360° F., typically about 330° F. In this cooling process, tar, oil and naphtha condense along with water and form two liquid phases. The phenol and ammonia, in addition to some $CO_2$, HCN and $H_2S$ dissolve in the water condensate. This two-phase flow of phenolic water containing ammonia, HCN, $H_2S$, $CO_2$ and fatty acids along with the liquid hydrocarbon phase is separated from the crude gas. The liquid organic phase of tar, oil and naphtha is separated and recovered in recovery unit 7.

The saturated crude gas is further cooled in unit 6 and brought to a temperature in a range of about 90° F. to about 110° F., usually about 100° F., and thereafter blended with gas from the entrained bed gasifier, as will be described in more detail hereinafter. The cooling may be carried out by utilizing low level heat for power recovery using a Rankin cycle, preheating boiler feed water and then heat exchange with cooling water.

The phenolic water separated from the tar and oil is pumped from the tar recovery unit 7 to the coal preparation area 1 where it is mixed with the coal fines that passed the ¼" screen in the preparation unit, while the tar and oil components are recovered and used as fuel for a steam superheater (not shown). The fines in the resultant slurry of coal in phenolic water are ground to a fine mesh. If necessary, fresh water or cooling tower blowdown may be added, and the slurry is pumped to a surge tank by centrifugal pump and may then be fed by a positive displacement pump to the entrained-bed gasifier 9 operating at a pressure in the range of about 400 to about 1200 and a temperature in the range of about 2200° F. to about 2700° F. (depending on the flow temperature of the ash). In the entrained bed gasifier or partial oxidation unit, the coal slurry, which contains dissolved organics, $NH_3$ and $CO_2$, reacts with oxygen to form synthesis gas. The ash thus formed is slagged, quenched, and leaves the system by suitable means such as a bottoms lock system and is passed to the ash dewatering unit 5.

A typical gas composition produced by the entrained bed gasifier utilizing, for example, Illinois No. 6 coal having the coal analysis noted above, is as follows:

| | | | |
|---|---|---|---|
| CO | 29.50% | $H_2S$ | 0.83% |
| $H_2$ | 23.50% | COS | 0.05% |
| $CO_2$ | 12.60% | $NH_3$ | 0.10% |
| $CH_4$ | 0.25% | HCN | 0.01% |
| $N_2$ | 0.90% | $H_2O$ | 32.10% |
| A | 0.15% | | |

The above gas composition is based on a slurry feed of 52.7 wt % coal (dry basis) in phenolic water, and gasification at 820 psig and 2450° F. The feed to the partial oxidation unit was 3252 T/Day coal (dry basis) and 242,600 lb/hr phenolic water containing 3 wt% dissolved phenols and 12 wt% dissolved ammonium carbonates. The total gas flow produced is 36,980 mol/hr. The gas from the entrained bed gasification is cooled in waste heat boiler (part of unit 9), generating steam at high pressure, usually 1650 psig, and then provides low level heat to a Rankin cycle, unit 8, while also preheating boiler feed water. The cooled gas is let down through an expander 10, thereby generating electric power if desired and equalizing the pressure of the gas stream from the moving bed gasifier, whereupon the two gas streams are blended, as shown at 11.

The combined gas stream produced from Illinois No. 6 coal may typically have the following composition:

| | | | |
|---|---|---|---|
| CO | 54.1% | $C_2H_6$ | 0.25% |
| $H_2$ | 31.9% | $H_2S$ | 1.37% |
| $CO_2$ | 5.51% | COS | 0.07% |
| $CH_4$ | 5.56% | $N_2$ | 0.51% |
| $C_2H_4$ | 0.16% | A | 0.11% |
| $C_3$, $C_4$, $C_5$, $C_6$, HCN Phenol - Less than 1% | | | |

Approximately 80% of the coal will be gasified by the moving bed gasifier, with the remainder by the slurry gasification. A total of 109,756 mol/hr of the synthesis gas may be produced.

After blending, the gas proceeds to the acid gas removal unit 12 where it is prewashed of water $C_4$ and heavier hydrocarbons at a temperature of about −30° F. by a selected physical solvent, usually methanol. The $C_4$+ hydrocarbon is recovered as a valuable by-product. The washed gas then proceeds to the main absorber 13 where the sulfur content is reduced to less than 0.5 ppm. Because of the low ratio of $CO_2$ to $H_2S$ in the feed gas, even if all the $CO_2$ where absorbed, the composition of the acid gas from the regeneration would be suitable for a Claus sulfur plant feed 14.

The desulfurized gas, typically having a composition similar to the following, proceeds to shift methanation unit 15.

| | | | |
|---|---|---|---|
| CO | 56.7% | $C_2H_4$ | 0.16% |
| $H_2$ | 33.4% | $C_2H_6$ | 0.23% |
| $CO_2$ | 2.88% | A + $N_2$ | 0.80% |
| $CH_4$ | 5.83% | | |

The total gas flow will ber about 104,542 mol/hr.

Desulfurized gas enters a multi-stage, adiabatic shift-methanation unit 15 where steam, exhausted or extracted from high pressure steam turbines, is added to the gas. The flow of the steam is about 1,000,000 lbs/hr at about 400 psig and about 620° F. The methanated gas, containing mostly $CO_2$, $CH_4$, and $H_2O$, is going through interstage cooling generating high pressure steam (usually 1650 psig). Part of the steam is also superheated in the methanation to 950° F. The steam may also be superheated by combustion of tar and oil by-products as previously mentioned. The gas leaving the unit is cooled by preheating inlet gas, boiler feedwater and providing heat to the Rankin cycle in unit 8. The gas is cooled to 150° F. and condensed water is separated and sent to a deaerator (not shown). The gas is then preheated to about 500° F. and re-fed to a final methanation 16. Methanated gas at about 600°-650° F. and about 295 psia is used to preheat the inlet gas thereupon cooling the methanated gas to 100° F.

The cold methanated gas having a flow of 70,400 mol/hr will have approximately the following composition:

CO: 0.07%
$H_2$: 0.19%
$CO_2$: 55.22%
$CH_4$: 43.04%
$N_2$+A: 1.20%
$H_2O$: 0.30%

This gas is then fed to the $CO_2$ removal system 17 which may employ the same physical solvent used for $H_2S$ removal, e.g., methanol. The gas is precooled to the $CO_2$ absorption temperature such that the bottom of the absorber is at about 270 psig. The composition of the resultant gas having a flow of 31,323 mol/hr is:

CO: 0.166%
$H_2$: 0.39%
$CO_2$: 0.32%
$CH_4$: 95.55%
$N_2$+A: 3.57%

Product gas at −35° F. is compressed by a centrifugal compressor 18 to 1200 psig. Refrigeration for the acid gas removal system is provided through a Rankin cycle. Low-level heat preheats propane to 285° F. at 900 psig. The superheated propane expands to about 220 psia, thus driving a propane compressor and electric power generator (not shown).

It will be appreciated that the gas produced from the slurry of coal fines and phenolic water is less suitable for SNG than the gas composition coming from the moving bed gasifier. As a result, ammonia, methanol, hydrogen or even a medium-BTU feed gas may be preferred final products from the portion of the synthesis gas generated by slurry gasification, in which case at least part of the gas produced in the entrained bed gasifier will not be blended with the gas from the moving bed gasifier, but instead will be processed directly utilizing conventional technology, to produce the desired product, as for example, the production of ammonia described in an article entitled, "Ammonia From Coal," by Netzer and Moe appearing in Chemical Engineering, Oct. 24, 1977.

I claim:

1. A process for the manufacture of fuel gas from coal which comprises sizing a coal feed to produce a first portion of larger particle sizes and a second portion of fine particles; gasifying (a) said first portion of coal feed in a moving bed slagging gasifier; quenching the gas thus produced to form a water phase comprising water, phenolic compounds, ammonia, $CO_2$, HCN, and $H_2S$ and a liquid organic phase comprising tar, oil and naphtha; separating and recovering said liquid organic phase; separating the water phase and mixing it with (a) said second portion of said coal feed to form a slurry; gasifying the coal in said slurry in an entrained bed gasifier; blending the gases generated by said gasifiers, and purifying the blend by removing $CO_2$, sulfur compounds and higher hydrocarbons, whereby fuel gas is produced and environmentally unsafe byproducts such as phenolic compounds are eliminated.

2. A process according to claim 1 wherein said coal feed is sized to approximately ¼"-2" with inadvertent production of undersize coal; using said sized coal as said first portion of coal and using said undersize coal as said second portion of coal.

3. A process according to claim 1 or 2 wherein the gas from said moving bed gasifier is used to manufacture fuel gas and part of the gas from said entrained bed gasifier is used for the manufacture of ammonia, methanol, or hydrogen.

4. The process of claim 1 in which the ash formed when said coal is gasified in said moving bed gasifier is formed into a slag and removed from said gasifier as molten ash.

5. An improved process for the manufacture of fuel gas from coal which comprises sizing a coal feed to produce a first portion of larger particle sizes and a second portion of fine particles; gasifying (a) said first portion of said coal feed in a moving bed gasifier; quenching the gas thus produced to form a water phase comprising water, phenolic compounds, ammonia, $CO_2$, HCN, and $H_2S$ and a liquid organic phase comprising tar, oil and naphtha; separating and recovering said liquid organic phase; separating the water phase and mixing it with a second portion of said coal to form a slurry; gasifying the coal in said slurry in an entrained bed gasifier, purifying the gas produced from said moving bed gasifier to remove $CO_2$, sulfur compounds and higher hydrocarbons and thereby produce environmentally safe fuel gas; and treating the gas produced in said entrained bed gasifier to produce ammonia, methanol or hydrogen.

6. In a process producing fuel gas from coal wherein coal is gasified by a process that produces a gas containing primary methane and is subsequently purified to produce the desired fuel gas, the improvement comprising sizing a coal feed to produce a first portion of larger particle sizes and a second portion of fine particles, gasifying said first portion in a moving bed gasifier to produce a gas containing primary methane, quenching said gas to form a water phase containing dissolved phenolic compounds and a liquid organic phase comprising tar, oil and naphtha, separating and recovering said liquid organic phase, separating said water phase from the gas phase and mixing the same with said second coal portion to form a coal containing slurry, and gasifying said coal in said slurry in an entrained bed gasifier.

7. The process of claim 6 in which said first coal portion is approximately ¼" to about 2" in particle size and said second coal portion is smaller in particle size than ¼".

8. The process of claim 7 in which at least part of the gas produced by said entrained bed gasifier is blended with said gas containing primary methane and is subsequently purified.

* * * * *